US010364575B2

(12) United States Patent
Ho

(10) Patent No.: US 10,364,575 B2
(45) Date of Patent: Jul. 30, 2019

(54) ELEVATION-TYPE STAIR STRUCTURE

(71) Applicant: Cheng-Yu Ho, Luodong Township (TW)

(72) Inventor: Cheng-Yu Ho, Luodong Township (TW)

( * ) Notice: Subject to any disclaimer, the term of this patent is extended or adjusted under 35 U.S.C. 154(b) by 0 days.

(21) Appl. No.: 15/962,360

(22) Filed: Apr. 25, 2018

(65) Prior Publication Data

US 2018/0320383 A1 Nov. 8, 2018

(30) Foreign Application Priority Data

May 2, 2017 (TW) ..... 106114494 A

(51) Int. Cl.

| | |
|---|---|
| ***E04F 11/04*** | (2006.01) |
| ***B66C 25/00*** | (2006.01) |
| ***A63G 31/16*** | (2006.01) |
| ***A63G 31/10*** | (2006.01) |

(52) U.S. Cl.

CPC ..... *E04F 11/04* (2013.01); *A63G 31/10* (2013.01); *A63G 31/16* (2013.01); *B66C 25/00* (2013.01)

(58) Field of Classification Search

CPC ..... B66C 25/00; B66B 9/00; B66B 9/0869; B66B 9/187; E04F 11/04

USPC ..... 472/2, 42, 48, 131; 52/182, 183, 185

See application file for complete search history.

(56) References Cited

U.S. PATENT DOCUMENTS 461,499 A * 10/1891 Ernst ..... B66F 11/04 182/141
708,838 A * 9/1902 Sferlozza ..... B66F 11/04 182/101
3,910,264 A * 10/1975 Mahieu ..... B64F 1/315 182/115
4,207,965 A * 6/1980 Chiang-Cheng ..... A62B 1/02 182/13
4,267,900 A * 5/1981 Yin-Lung ..... A62B 35/0062 182/13
4,355,699 A * 10/1982 Smith, Jr. ..... A62B 1/02 182/12
4,386,680 A * 6/1983 Reed ..... B66B 9/00 182/142
4,424,884 A * 1/1984 Smith, Jr. ..... A62B 1/02 182/12

(Continued)

FOREIGN PATENT DOCUMENTS

| | | |
|---|---|---|
| TW | I323655 | 4/2010 |
| TW | M504587 | 7/2015 |

*Primary Examiner* — James M Ference

(74) *Attorney, Agent, or Firm* — Guice Patents PLLC

(57) ABSTRACT

An elevation-type stair structure comprises: a first stair module, including plural first treads and a first wall surface having a first door and a second door; a second stair module, including plural second treads and a second wall surface having a third door and a fourth door; and an elevator module, enabling the first stair module or the second stair module to be ascended or descended, when the second stair module is ascended for being above a location defined at one side of the first stair module, the second door is aligned with the third door, when the second stair module is descended for being below a location defined at one side of the first stair module, the first door is aligned with the fourth door. Accordingly, a user can walk through the first stair module and the second stair module then return to an original location.

10 Claims, 8 Drawing Sheets

(56) References Cited

U.S. PATENT DOCUMENTS 4,469,198 A * 9/1984 Crump ..... B66B 9/00 169/48
4,556,123 A * 12/1985 Hargest, III ..... A62B 35/005 182/10
4,557,353 A * 12/1985 Pichon ..... B66B 9/187 187/239
4,707,957 A * 11/1987 Shepherd ..... E04F 11/06 182/115
4,865,155 A * 9/1989 Montaigne ..... A62B 1/02 182/14
5,103,934 A * 4/1992 Brooks ..... E04F 11/068 182/106
5,127,491 A * 7/1992 Just-Buddy ..... A62B 1/00 182/142
5,234,078 A * 8/1993 Smith ..... B66B 9/0869 187/200
5,377,778 A * 1/1995 Lan ..... A62B 1/20 182/100
5,392,877 A * 2/1995 Shahin ..... A62B 1/02 182/82
5,937,971 A * 8/1999 Storm ..... B66B 9/0869 187/200
6,318,503 B1 * 11/2001 Hernandez ..... A62B 1/02 182/144
6,684,978 B1 * 2/2004 Gupta ..... A62B 1/20 182/36
7,096,998 B1 * 8/2006 Edmunds ..... B66B 9/0869 182/141
8,151,941 B2 * 4/2012 Moses ..... B66B 9/187 182/37
8,839,475 B2 * 9/2014 Corfield ..... B64F 1/315 14/71.5
9,238,512 B1 * 1/2016 Keith ..... B65G 69/30
2004/0195045 A1 * 10/2004 Richey ..... B66B 9/00 187/239
2005/0097835 A1 * 5/2005 Nishimoto ..... E04F 11/112 52/182
2005/0217939 A1 * 10/2005 Nielsen ..... B66B 9/0869 187/200
2006/0049312 A1 * 3/2006 Ganiere ..... B64F 1/3055 244/137.2
2006/0182581 A1 * 8/2006 Murray ..... B66B 9/0869 414/541
2008/0190049 A1 * 8/2008 Muti ..... E04G 27/00 52/183
2008/0236065 A1 * 10/2008 Conservano ..... E04F 11/022 52/185
2010/0293875 A1 * 11/2010 Preston ..... E04F 11/022 52/183
2015/0175387 A1 * 6/2015 Lin ..... B66B 1/24 187/200
2018/0320383 A1 * 11/2018 Ho ..... B66C 25/00

* cited by examiner

ELEVATION-TYPE STAIR STRUCTURE

BACKGROUND OF THE INVENTION

1. Field of the Invention

The present invention relates to an elevation-type stair structure, especially to an elevation-type stair structure comprising a first stair module, a second stair module and an elevator module and allowing a user to walk through the first stair module and the second stair module and then return to an original location.

2. Description of Related Art

A conventional building is mostly installed with at least one stair structure, except a one-story building. The stair installed in an apartment allows residents to walk upwardly or downwardly. The stair installed in a building not only allows residents to walk upwardly or downwardly but also provides an emergency escaping function.

A conventional stair structure having an elevator is also disclosed in prior art; take Taiwan Patent No. I323655, titled in "Assistant device for assisting climbing up and down stairs", for instance, the assistant device for assisting climbing up and down stairs comprises a handrail used for being held, two spring mechanisms and two control handles, wherein a first linkage member having an elastically extendable first locking tongue is respectively disposed at side wings at two sides of the handrail, the spring mechanisms are disposed at the backside of the handrail and horizontally connected to each of the first linkage members, the control handles are disposed on the handrail for being pulled by a hand and connected to a second linkage member through a connecting shaft; by pressing the first locking tongue with the handrail to make the first locking tongue retract, a user can climb up stairs successfully without pulling the control handles; and when the user goes down stairs and pulls the control handles, the second linkage member is served to link the spring mechanisms which causes a pulling and pushing action to the first locking tongue, as a result, the first locking tongue moves back into the side wing and makes the assistant device slide along the handrail, or the first locking tongue protrudes out of the side wing and temporarily stop the motion of the assistant device.

Moreover, Taiwan Utility Model Publication No. M504587 has disclosed a stairs assistive device for moving up and down, the stairs assistive device comprises a fasten device on which a long rod part and a hook part are disposed, the long rod part can be rotated relative to the hook part, and the hook part enables the fasten device to be hooked on a handrail of a stair, the long rod part of the fasten device is connected to an elevation device, the elevation device is able to be supported on a tread of the stair, and the elevation device includes a support rod for supporting a carry device, wherein the support rod can protrude out from the elevation device for allowing the carry device to be upwardly/downwardly moved with respect to a retracting motion of the support rod, so that a user can be upwardly or downwardly guided so as to reach the treas.

However, the above-mentioned stairs or the assistant device for assisting climbing up and down stairs only provide a function of enabling the user to upwardly/downwardly walk, there is no stair structure which can provide a game-like activity of upwardly and downwardly walking through the stairs then return to an original location, therefore this shortage shall be seriously concerned by the skilled people in the art.

SUMMARY OF THE INVENTION

One primary objective of the present invention is to provide an elevation-type stair structure, which can provide a game-like activity of allowing a user to walk through a first stair module and a second stair module then return to an original location.

For achieving said objective, one technical solution provided by the present invention is to provide an elevation-type stair structure, which comprises: a first stair module, including a plurality of first treads, a first platform, a second platform and a first wall surface, wherein the first wall surface includes a first door and a second door; a second stair module, disposed at one side of the first stair module and an oriented direction thereof being opposite to that of the first stair module, and including a plurality of second treads, a third platform, a fourth platform and a second wall surface, wherein the second wall surface includes a third door and a fourth door; and an elevator module, fastened above the first stair module or the second stair module for enabling the first stair module or the second stair module to be ascended or descended, when the second stair module is ascended for being above a location defined at one side of the first stair module, the second door is aligned with the third door, when the second stair module is descended for being below a location defined at one side of the first stair module, the first door is aligned with the fourth door.

According to one preferred embodiment of the present invention, the plural first treads further include a first partition plate, a second partition plate, a first stop plate and a second stop plate, wherein, the first partition plate is mounted in the plural first treads, and arranged at a location defined at one third of a width of the first tread from the right, the second partition plate is mounted in the plural first treads, arranged at a location defined at two third of the width of the first tread from the right, arranged to be parallel to the first partition plate and the height thereof is slightly higher than the first partition plate; the first stop plate is disposed at top ends of the plural first treads, connected to an upper distal end of the second partition plate and arranged to be adjacent to the first wall surface; the second stop plate is disposed at bottom ends of the plural first treads and connected to a distal end of the first partition plate; accordingly, with a circuitous path formed by the first partition plate, the second partition plate, the first stop plate and the second stop plate, more time is required for a user walking on the stair.

According to one preferred embodiment of the present invention, the plural second treads further include a third partition plate, a fourth partition plate, a third stop plate and a fourth stop plate, wherein, the third partition plate is mounted in the plural second treads, and arranged at a location defined at one third of a width of the second tread from the right; the fourth partition plate is mounted in the plural second treads, arranged at a location defined at two third of the width of the second tread from the right, arranged to be parallel to the third partition plate and the height thereof is slightly lower than the third partition plate; the third stop plate is disposed at top ends of the plural second treads, connected to an upper distal end of the third partition plate and arranged to be adjacent to the second wall surface; the fourth stop plate is disposed at bottom ends of the plural second treads and connected to a distal end of the fourth partition plate; accordingly, with a circuitous path formed by the third partition plate, the fourth partition plate, the third stop plate and the fourth stop plate, more time is required for the user walking on the stair.

According to one preferred embodiment of the present invention, the first stair module and the second stair module is a stair module made of a wooden, aluminum, iron or stainless steel material.

According to one preferred embodiment of the present invention, the elevator module is an electric elevator.

According to one preferred embodiment of the present invention, the second stair module is disposed at the left side of the first stair module, and the second wall surface is arranged to be adjacent to the first wall surface.

According to one preferred embodiment of the present invention, the first door, the second door, the third door and the fourth door are an opening/closing type wooden door, aluminum door, iron door or stainless steel door.

According to one preferred embodiment of the present invention, a separation part is further disposed between the plural second treads and the second wall surface, wherein a top end of the separation part is connected to one end of the third partition plate, and a bottom end of the separation part is bent for being vertical to the third platform.

BRIEF DESCRIPTION OF THE DRAWINGS

The present invention will be apparent to those skilled in the art by reading the following detailed description of a preferred embodiment thereof, with reference to the attached drawings, in which.

DETAILED DESCRIPTION OF THE PREFERRED EMBODIMENT

Figure 1:
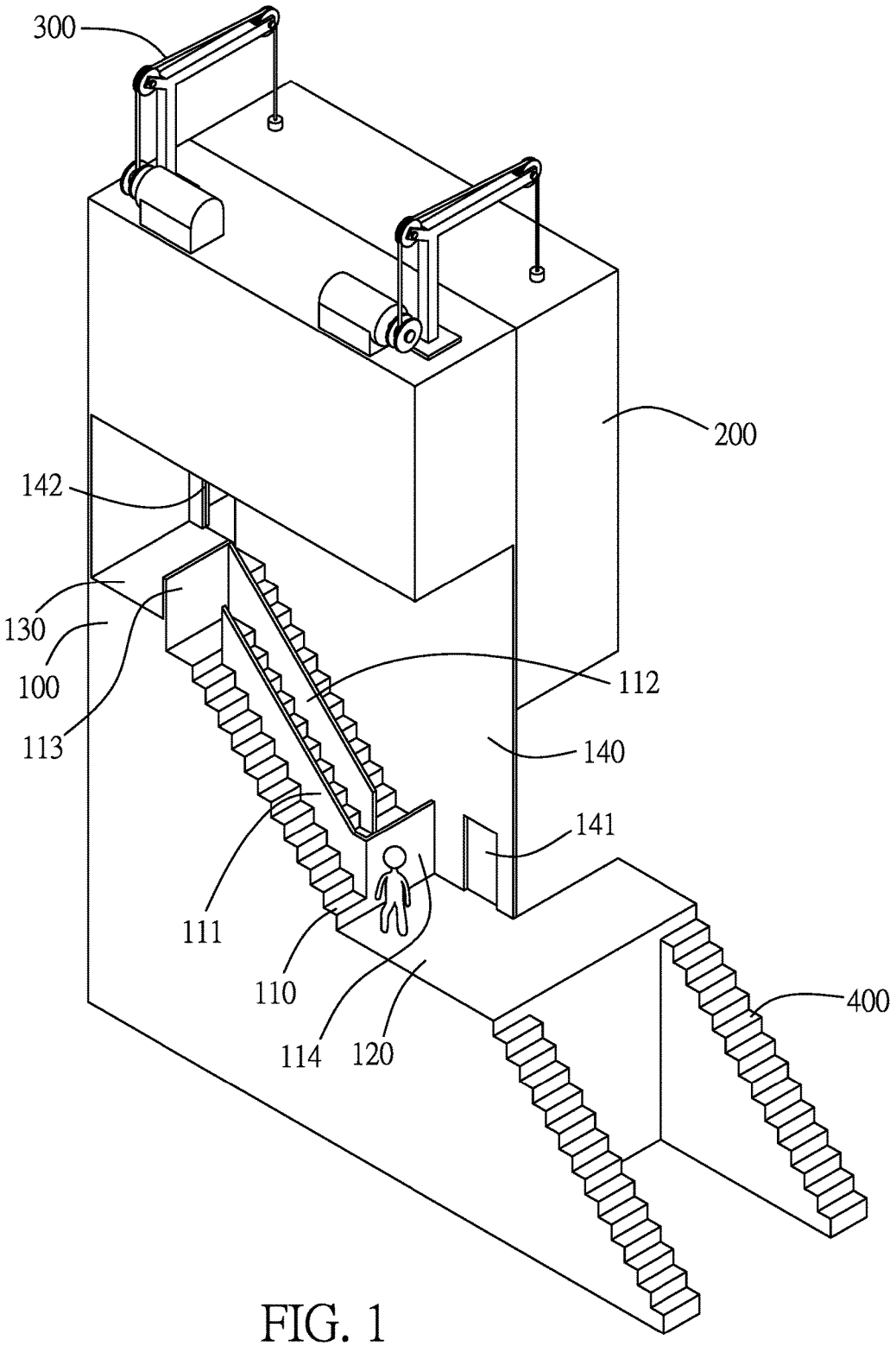
FIG. 1 is a schematic view illustrating one side of the assembly of the elevation-type stair structure according to one preferred embodiment of the present invention.
Figure 2:
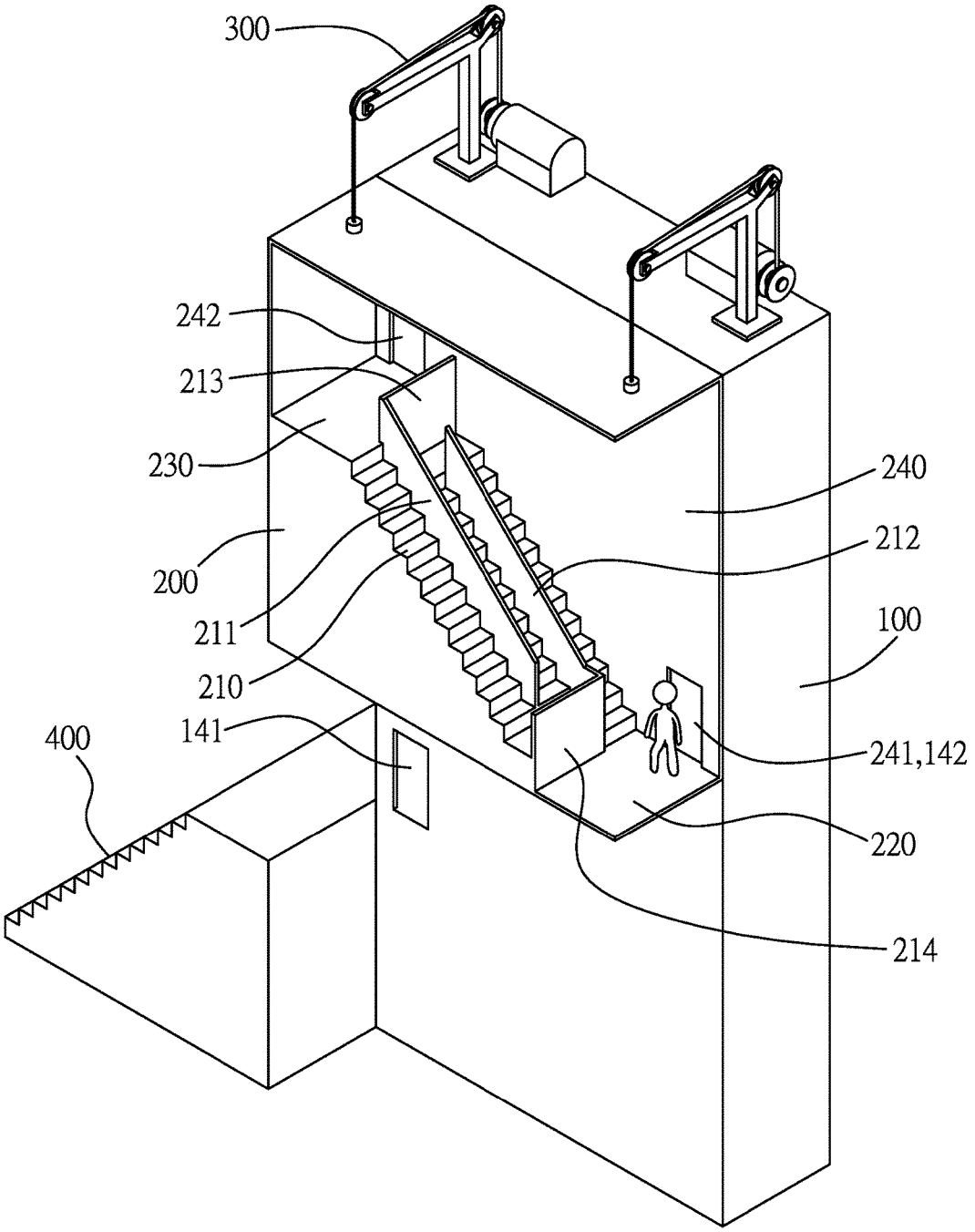
FIG. 2 is a schematic view illustrating another side of the assembly of the elevation-type stair structure according to one preferred embodiment of the present invention.

Please refer to FIG. 1 and FIG. 2, wherein FIG. 1 is a schematic view illustrating one side of the assembly of the elevation-type stair structure according to one preferred embodiment of the present invention; and FIG. 2 is a schematic view illustrating another side of the assembly of the elevation-type stair structure according to one preferred embodiment of the present invention.

As shown in figures, the present invention provides an elevation-type stair structure comprising a first stair module 100, a second stair module 200 and an elevator module 300.

The first stair module 100 includes a plurality of first treads 110, a first platform 120, a second platform 130 and a first wall surface 140. The first wall surface 140 includes a first door 141 and a second door 142. Wherein, the first stair module 100 is, for example but not limited to, a stair module made of a wooden, aluminum, iron or stainless steel material, and the first door 141 and the second door 142 are, for example but not limited to, an opening/closing type wooden door, aluminum door, iron door or stainless steel door.

Moreover, the plural first treads 110 further include a first partition plate 111, a second partition plate 112, a first stop plate 113 and a second stop plate 114.

Wherein, the first partition plate 111 is mounted in the plural first treads 110, and arranged at a location defined at one third of a width of the first tread 110 from the right; the second partition plate 112 is mounted in the plural first treads 110, arranged at a location defined at two third of the width of the first tread 110 from the right, arranged to be parallel to the first partition plate 111 and the height thereof is slightly higher than the first partition plate 111; the first stop plate 113 is disposed at top ends of the plural first treads 110, connected to an upper distal end of the second partition plate 112 and arranged to be adjacent to the first wall surface 140; the second stop plate 114 is disposed at bottom ends of the plural first treads 110 and connected to a distal end of the first partition plate 111; accordingly, with a circuitous path formed by the first partition plate 111, the second partition plate 112, the first stop plate 113 and the second stop plate 114, a user shall spend more time walking on the stair.

The second stair module 200 is disposed at one side of the first stair module 100, for example but not limited to the right side, and an oriented direction thereof can be the same or opposite to an oriented direction of the first stair module 100; according to this embodiment, an arrangement of the oriented direction of the second stair module 200 being opposite to the oriented direction of the first stair module 100 is adopted for illustrations, and shall not be a limitation to the scope of the present invention. The second stair module 200 includes a plurality of second treads 210, a third platform 220, a fourth platform 230 and a second wall surface 240. The second wall surface 240 includes a third door 241 and a fourth door 242, wherein the second wall surface 240 is arranged to be adjacent to the first wall surface 140. Wherein, the second stair module 200 is, for example but not limited to, a stair module made of a wooden, aluminum, iron or stainless steel material, and the third door 241 and the fourth door 242 are, for example but not limited to, an opening/closing type wooden door, aluminum door, iron door or stainless steel door.

Moreover, the plural second treads 210 further include a third partition plate 211, a fourth partition plate 212, a third stop plate 213 and a fourth stop plate 214.

Wherein, the third partition plate 211 is mounted in the plural second treads 210, and arranged at a location defined at one third of a width of the second tread 210 from the right; the fourth partition plate 212 is mounted in the plural second treads 210, arranged at a location defined at two third of the width of the second tread 210 from the right, arranged to be parallel to the third partition plate 211 and the height thereof is slightly lower than the third partition plate 211; the third stop plate 213 is disposed at top ends of the plural second treads 210, connected to an upper distal end of the third partition plate 213 and arranged to be adjacent to the second wall surface 240; the fourth stop plate 214 is disposed at bottom ends of the plural second treads 210 and connected to a distal end of the fourth partition plate 214; accordingly, with a circuitous path formed by the third partition plate 211, the fourth partition plate 212, the third stop plate 213 and the fourth stop plate 214, the user shall spend more time walking on the stair.

The elevator module 300 is fastened above the first stair module 100 or the second stair module 200 for enabling the first stair module 100 or the second stair module 200 to be ascended or descended. According to this embodiment, an arrangement of the elevator module 300 being fastened above the second stair module 200 is adopted for illustrations and shall not be a limitation to the scope of the present invention. When the second stair module 200 is ascended for being above a location defined at one side of the first stair module 100, the second door 142 is aligned with the third door 241; when the second stair module 200 is descended for being below a location defined at one side of the first stair module 100, the first door 141 is aligned with the fourth door 242. Wherein, the elevator module 300 is, for example but not limited to, an electric elevator.

Moreover, the elevation-type stair structure provided by the present invention further comprises a guide stair 400 and a machine room (not shown in figures). Wherein, the guide stair 400 is located in front of the first stair module 100 and used for guiding the user to the first stair module 100, and the backside thereof is formed with an accommodation space (not shown in figures) for accommodating the second stair module 200. The machine room is located above the second stair module 200 and used for accommodating the elevator module 300.

Figure 3:
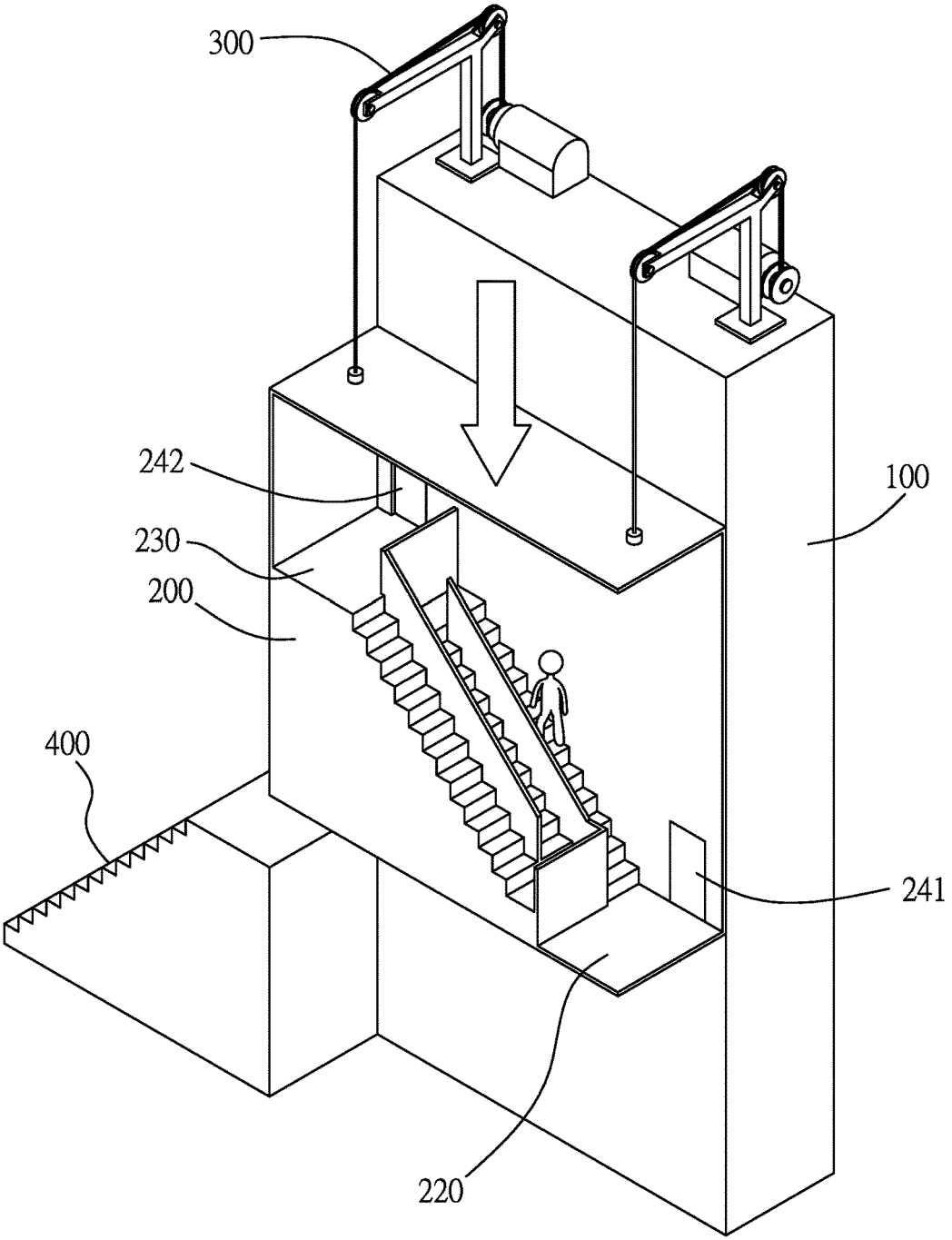
FIG. 3 is a schematic view illustrating the second stair module starting to be descended according to one preferred embodiment of the present invention.
Figure 4:
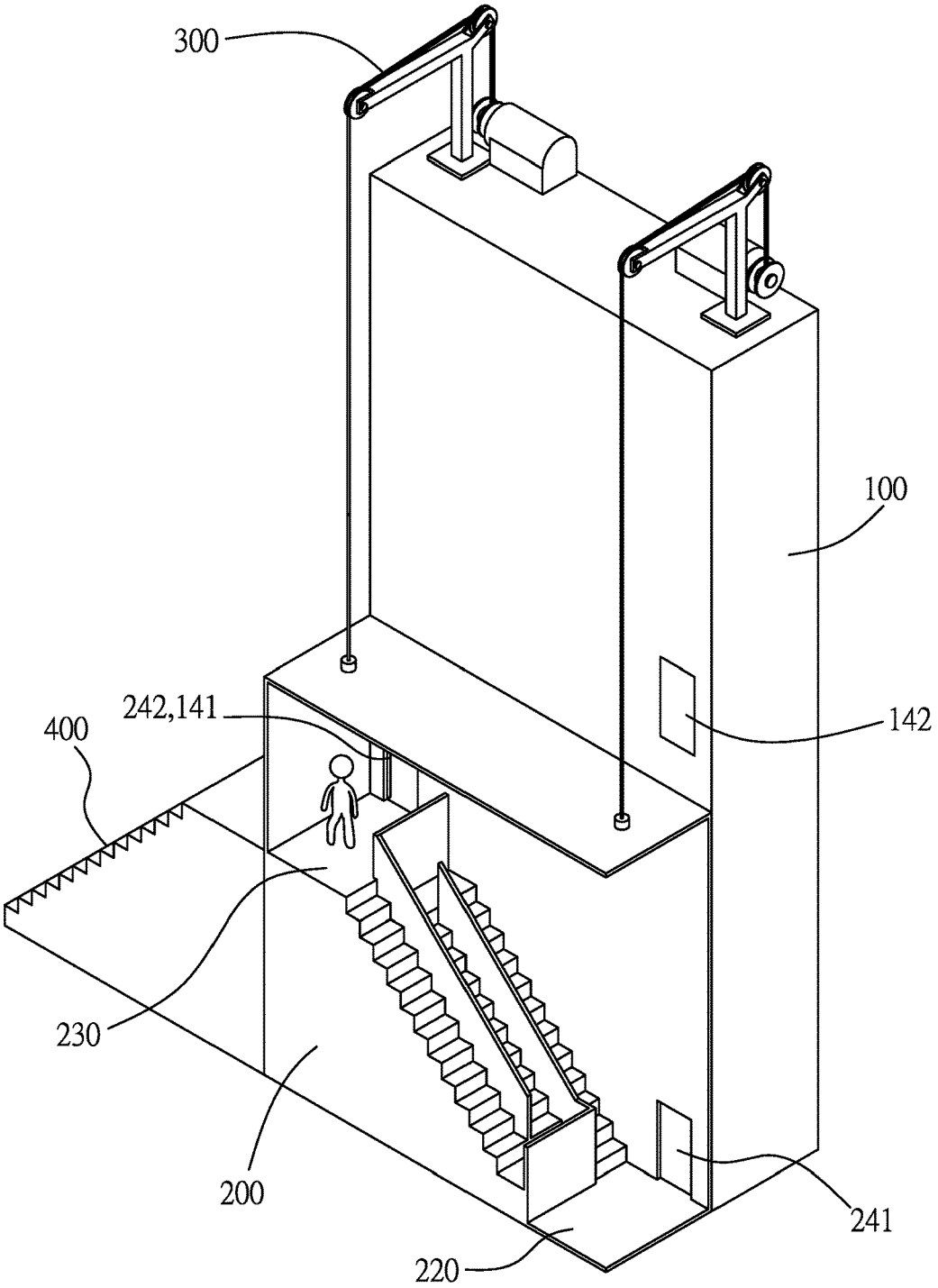
FIG. 4 is a schematic view illustrating the second stair module being descended and positioned according to one preferred embodiment of the present invention.
Figure 5:
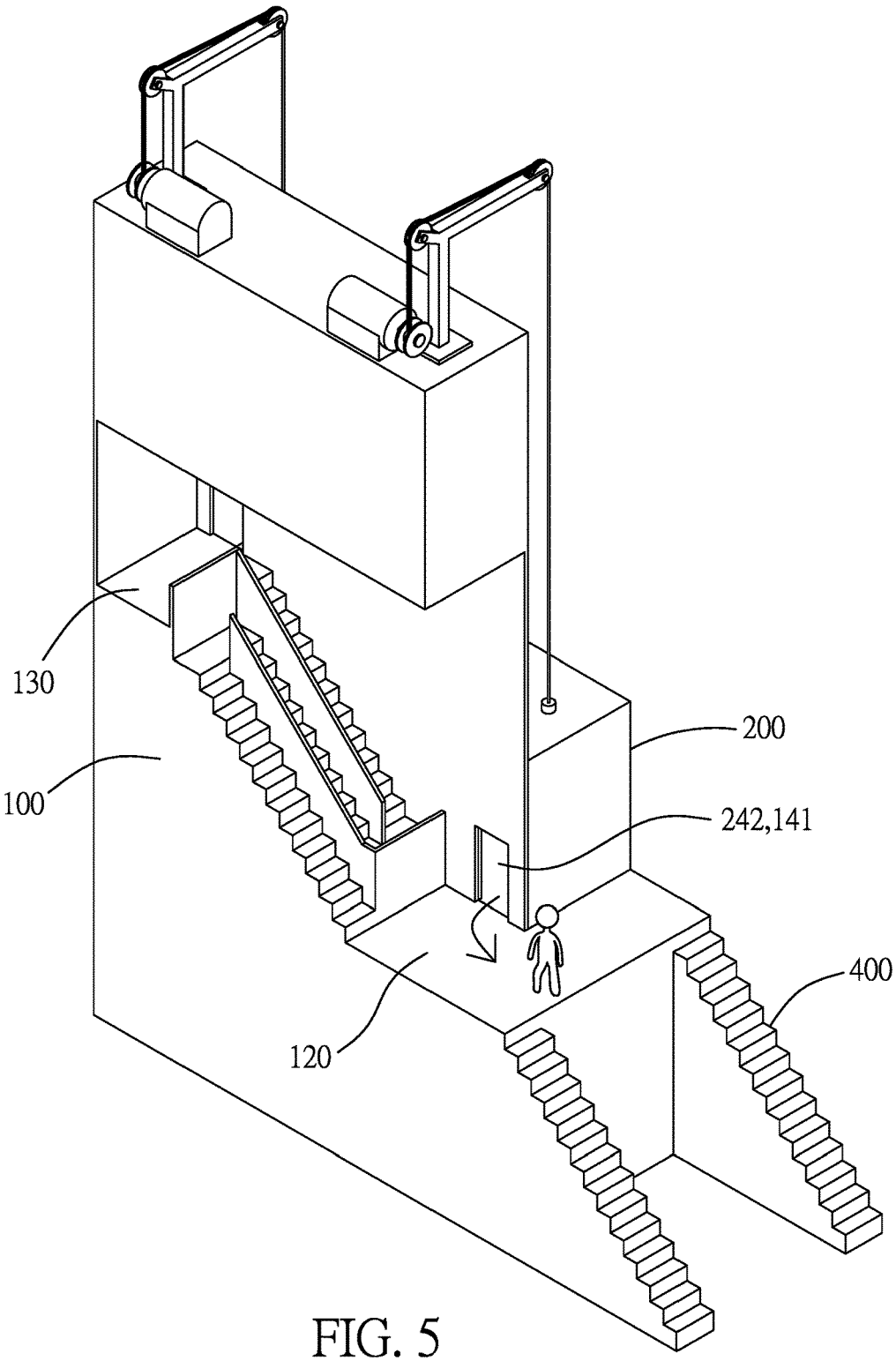
FIG. 5 is a schematic view illustrating the user leaving via the guide stair according to one preferred embodiment of the present invention.
Figure 6:
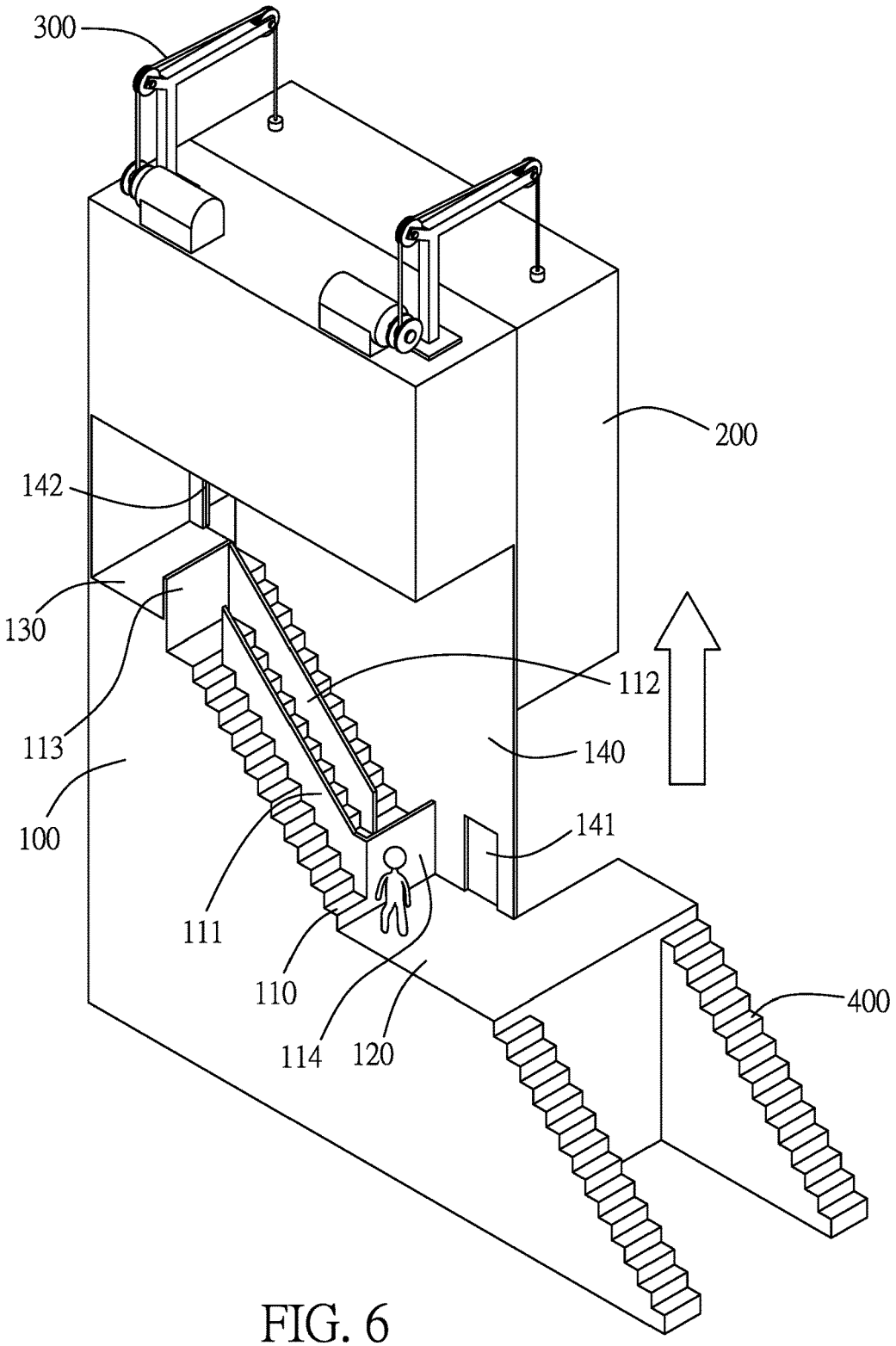
FIG. 6 is a schematic view illustrating a status of the second stair module being ascended to for being above the first stair module according to one preferred embodiment of the present invention.

Please refer to FIG. 3 to FIG. 6, wherein FIG. 3 is a schematic view illustrating the second stair module starting to be descended according to one preferred embodiment of the present invention; FIG. 4 is a schematic view illustrating the second stair module being descended and positioned according to one preferred embodiment of the present invention; FIG. 5 is a schematic view illustrating the user leaving via the guide stair according to one preferred embodiment of the present invention; and FIG. 6 is a schematic view illustrating a status of the second stair module being ascended for being above the first stair module according to one preferred embodiment of the present invention.

As shown in FIG. 1, in an initial status, the elevation-type stair structure of the present invention allows the second stair module 200 to be above a location defined at one side of the first stair module 100; when the user walks to the first platform 120 via the guide stair 400 and starts to upwardly walk on the first stair module 100, and the user can walk to the second platform 130 via the circuitous path formed by the first partition plate 111, the second partition plate 112, the first stop plate 113 and the second stop plate 114. At this moment, the second door 142 and the third door 241 are both opened, so that the user can walk to the third platform 220 of the second stair module 200 via the second door 142 and the third door 241.

As shown in FIG. 3, when the user starts to upwardly walk on the second stair module 200 via the third platform 220, meanwhile the elevator module 300 is actuated for enabling the second stair module 200 to be descended.

As show in FIG. 4, when the second stair module 200 is descended for being below a location defined at one side of the first stair module 100, the fourth door 242 is aligned with the first door 141, meanwhile the fourth door 242 and the first door 141 are opened, so that the user can walk to the first platform 120 of the first stair module 100, in other words the user has returned to an original location; wherein, with the circuitous path formed by the third partition plate 211, the fourth partition plate 212, the third stop plate 213 and the fourth stop plate 214, the user shall spend more time walking on the stair, so that the elevator module 300 is provided with a sufficient working time to descend and position the second stair module 200.

As shown in FIG. 5, when the user starts to downwardly walk on the guide stair 400, the elevator module 300 is actuated for enabling the second stair module 200 to be ascended; when the second stair module 200 is ascended for being above a location defined at one side of the first stair module 100, the second door 142 is aligned with the third door 241, in other words the initial status is reestablished.

As shown in FIG. 6, when a next user starts to upwardly walk on the first stair module 100, the process is the same as what has been disclosed in FIG. 3, therefore no further illustration is provided.

Figure 7:
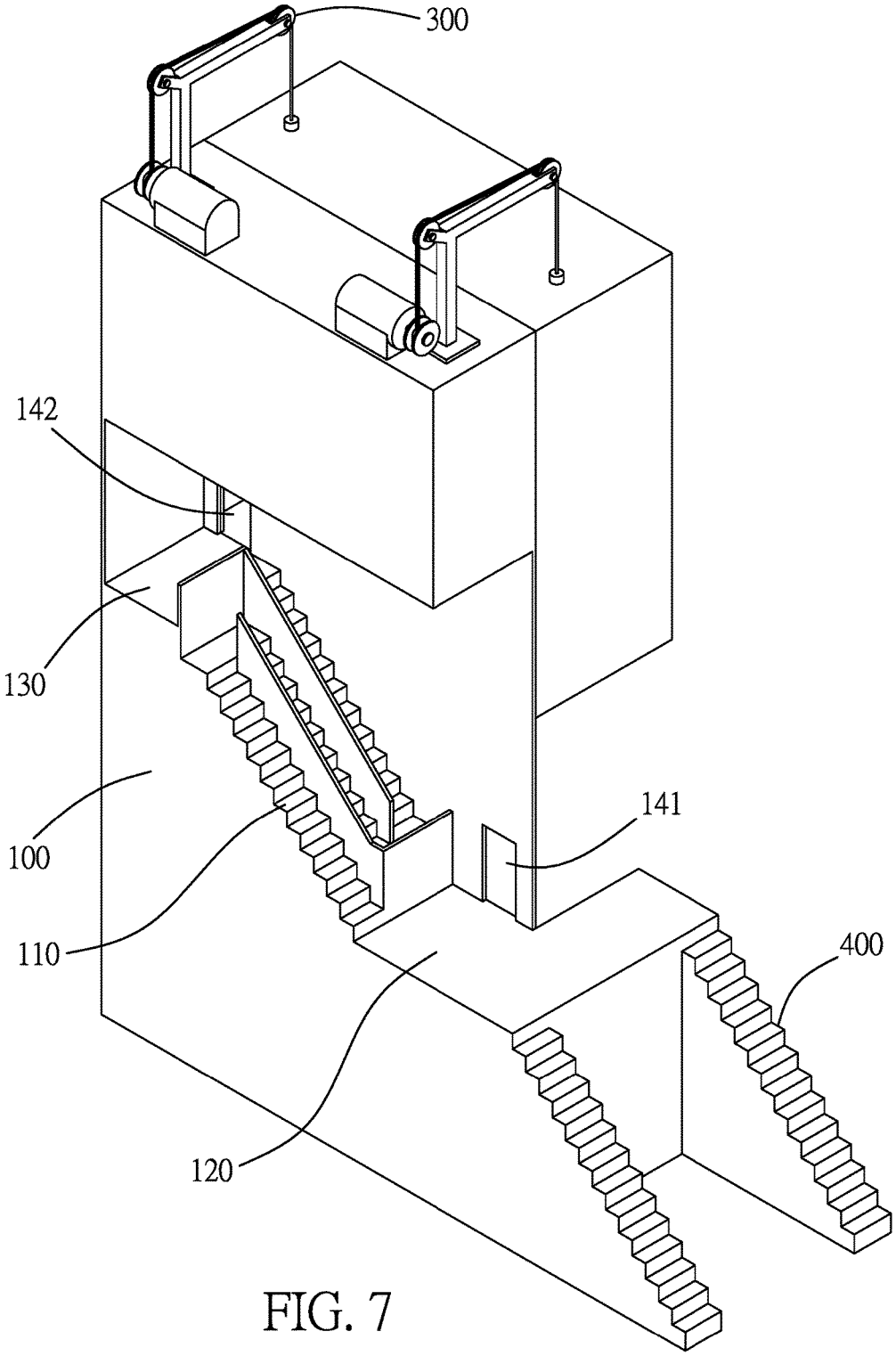
FIG. 7 is a schematic view illustrating one side of the assembly of the elevation-type stair structure according to another preferred embodiment of the present invention.
Figure 8:
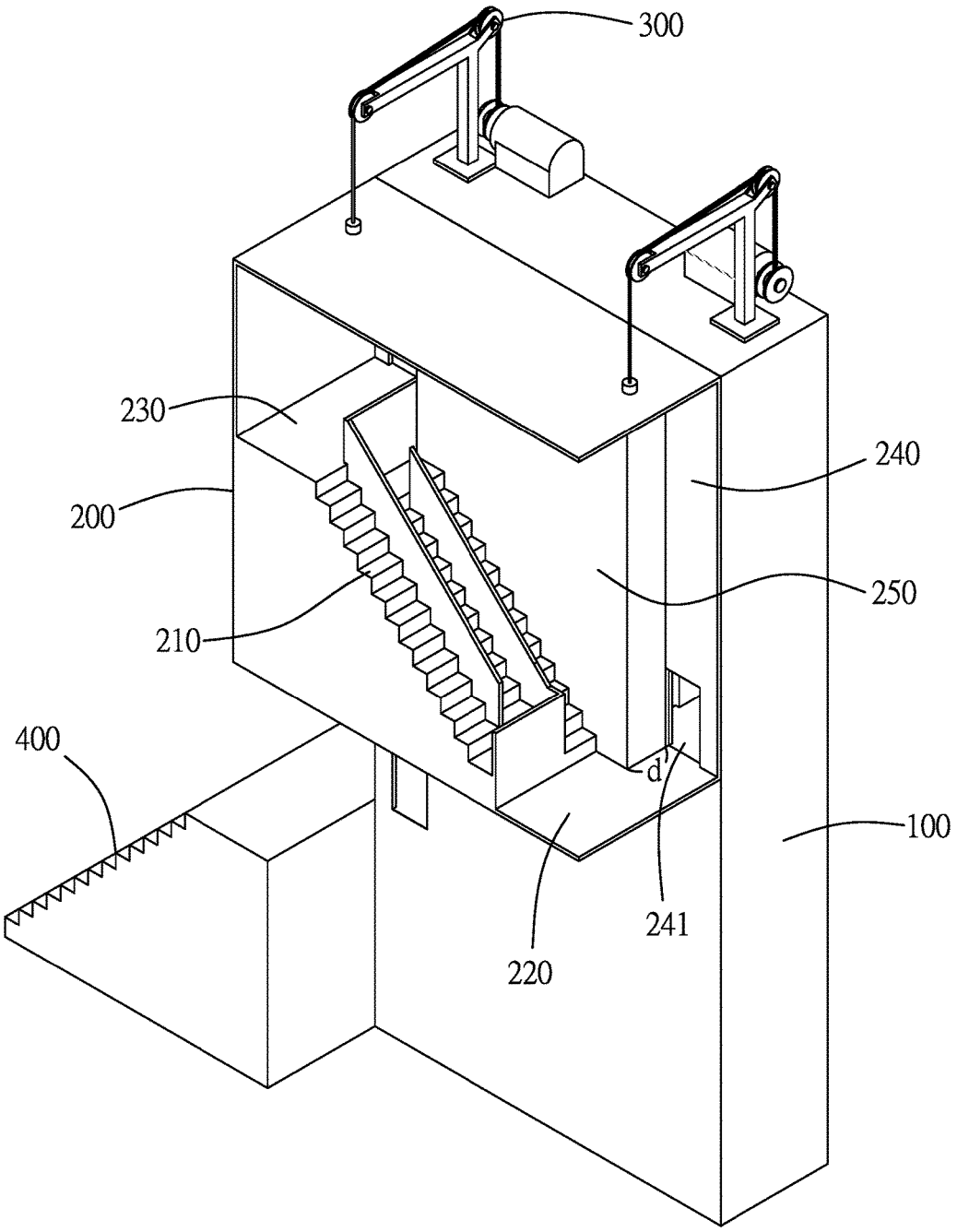
FIG. 8 is a schematic view illustrating another side of the assembly of the elevation-type stair structure according to another preferred embodiment of the present invention.

Please refer to FIG. 7 to FIG. 8, wherein FIG. 7 is a schematic view illustrating one side of the assembly of the elevation-type stair structure according to another preferred embodiment of the present invention; and FIG. 8 is a schematic view illustrating another side of the assembly of the elevation-type stair structure according to another preferred embodiment of the present invention.

As shown in figures, according to the elevation-type stair structure disclosed in another preferred embodiment of the present invention, a separation part 250 is further disposed between the plural second treads 210 and the second wall surface 240, wherein a top end of the separation part 250 is connected to the top end of the second stair module 200, and a bottom end of the separation part 250 is vertical to the third platform 220. Wherein, the width of the separation part 250 is defined as d, so that a distance same as the d is formed between the plural second treads 210 and the second wall surface 240.

Based on what has been disclosed above, an advantage achieved by the present invention is as followings: with the elevation-type stair structure provided by the present invention, the user can enjoy the game in which the stair structure allows the user to walk through the first stair module and the second stair module and then return to the original location.

Many modifications and other embodiments of the inventions set forth herein will come to mind to one skilled in the art to which these inventions pertain having the benefit of the teachings presented in the foregoing descriptions and the associated drawings. Therefore, it is to be understood that the inventions are not to be limited to the specific examples of the embodiments disclosed and that modifications and other embodiments are intended to be included within the scope of the appended claims. Although specific terms are employed herein, they are used in a generic and descriptive sense only and not for purposes of limitation.

What is claimed is:

1. An elevation-type stair structure, comprising:

a first stair module, including a plurality of first treads, a first platform, a second platform and a first wall surface, wherein said first wall surface includes a first door and a second door;

a second stair module, disposed at one side of said first stair module and including a plurality of second treads, a third platform, a fourth platform and a second wall surface, wherein said second wall surface includes a third door and a fourth door; and an elevator module, fastened above said first stair module or said second stair module for enabling said first stair module or said second stair module to be ascended or descended, wherein when said second stair module is descended for being below a location defined at said one side of said first stair module, said first door is aligned with said fourth door; and when said second stair module is ascended for being above a location defined at said one side of said first stair module, said second door is aligned with said third door.

2. The elevation-type stair structure as claimed in claim 1, wherein an oriented direction of said first stair module is opposite to an oriented direction of said second stair module.

3. The elevation-type stair structure as claimed in claim 1, wherein said plurality of first treads further include a first partition plate, a second partition plate, a first stop plate and a second stop plate, wherein said first partition plate is mounted in said plurality of first treads, and arranged at a location defined at one third of a width of said first tread from a right, said second partition plate is mounted in said plurality of first treads, arranged at a location defined at two third of said width of said first tread from the right, arranged to be parallel to said first partition plate and a height thereof is slightly higher than said first partition plate; said first stop plate is disposed at top ends of said plurality of first treads and connected to an upper distal end of said second partition plate; said second stop plate is disposed at bottom ends of said plurality of first treads and connected to a distal end of said first partition plate; accordingly, with a circuitous path formed by said first partition plate, said second partition plate, said first stop plate and said second stop plate, more time is required for a user walking on said stair.

4. The elevation-type stair structure as claimed in claim 1, wherein said plurality of second treads further include a third partition plate, a fourth partition plate, a third stop plate and a fourth stop plate, wherein said third partition plate is mounted in said plurality of second treads, and arranged at a location defined at one third of a width of said second tread from a right; said fourth partition plate is mounted in said plurality of second treads, arranged at a location defined at two third of said width of said second tread from the right, arranged to be parallel to said third partition plate and a height thereof is slightly lower than said third partition plate; said third stop plate is disposed at top ends of said plurality of second treads, connected to an upper distal end of said third partition plate and arranged to be adjacent to said second wall surface; said fourth stop plate is disposed at bottom ends of said plurality of second treads and connected to a distal end of said fourth partition plate; accordingly, with a circuitous path formed by said third partition plate, said fourth partition plate, said third stop plate and said fourth stop plate, more time is required for said user walking on said stair.

5. The elevation-type stair structure as claimed in claim 4, further comprising a separation part disposed between said plurality of second treads and said second wall surface, wherein a top end of said separation part is connected to a top end of said second stair module, and a bottom end of said separation part is located above said third platform.

6. The elevation-type stair structure as claimed in claim 1, wherein each of said first stair module and said second stair module is a stair module made of a wooden, aluminum, iron or stainless steel material.

7. The elevation-type stair structure as claimed in claim 1, wherein said elevator module is an electric elevator.

8. The elevation-type stair structure as claimed in claim 1, wherein said second stair module is disposed at a left side of said first stair module, and said second wall surface is arranged to be adjacent to said first wall surface.

9. The elevation-type stair structure as claimed in claim 1, wherein said first door, said second door, said third door and said fourth door are each a wooden door, aluminum door, iron door or stainless steel door capable of being opened and closed.

10. The elevation-type stair structure as claimed in claim 1, further comprising a guide stair and a machine room, wherein said guide stair is located in front of said first stair module and used for guiding said user to said first stair module, and a backside thereof is formed with an accommodation space for accommodating said second stair module; said machine room is located above said second stair module and used for accommodating said elevator module.

* * * * *